US010602783B1

(12) United States Patent
Colligan et al.

(10) Patent No.: US 10,602,783 B1
(45) Date of Patent: Mar. 31, 2020

(54) MULTI-FUNCTION GARMENT

(71) Applicant: Victoria Colligan, Shaker Heights, OH (US)

(72) Inventors: Victoria Colligan, Shaker Heights, OH (US); Caeli M. Regan, Cleveland Heights, OH (US); Valerie A. Priebe, Cleveland Heights, OH (US)

(73) Assignee: Victoria Colligan, Shaker Heights, OH (US)

( * ) Notice: Subject to any disclaimer, the term of this patent is extended or adjusted under 35 U.S.C. 154(b) by 99 days.

(21) Appl. No.: 15/948,521

(22) Filed: Apr. 9, 2018

Related U.S. Application Data

(60) Provisional application No. 62/483,036, filed on Apr. 7, 2017.

(51) Int. Cl.

| | |
|---|---|
| ***A41D 3/08*** | (2006.01) |
| ***A41D 15/04*** | (2006.01) |
| ***A47G 9/02*** | (2006.01) |
| ***A47G 9/06*** | (2006.01) |

(52) U.S. Cl.
CPC ..... *A41D 3/08* (2013.01); *A41D 15/04* (2013.01); *A47G 9/064* (2013.01); *A41D 2300/326* (2013.01); *A41D 2400/48* (2013.01); *A47G 9/0223* (2013.01)

(58) Field of Classification Search
CPC ..... A45F 4/14; A47G 9/064; A47G 9/0223; A41D 3/08; A41D 15/04; A47C 7/021
USPC ..... 2/69, 69.5, 88, 209.11, 209.12
See application file for complete search history.

(56) References Cited

U.S. PATENT DOCUMENTS

| | | | | |
|---|---|---|---|---|
| 4,563,776 | A * | 1/1986 | Boesen | A41D 15/04 2/85 |
| 4,752,971 | A * | 6/1988 | Meserol | A41D 3/08 2/84 |
| 6,003,749 | A * | 12/1999 | Sabo | A01M 31/00 2/114 |
| 2019/0246712 | A1 * | 8/2019 | Sonksen | A41D 3/08 |

* cited by examiner

*Primary Examiner* — Katherine M Moran
(74) *Attorney, Agent, or Firm* — Pearne & Gordon LLP

(57) ABSTRACT

A multi-function garment has an inner face and an outer face. The garment may be worn as a cape via shoulder straps in the form of first and second straps attached to a first face of the garment. Unattached portions of the first and second straps are usable as the shoulder straps when attached to complementary fasteners on the respective face. In embodiments, the garment is reversible by threading the unattached portions of the straps through slits in the garment so that they can extend over either the first or the second face as desired. The garment is usable as a blanket when not being worn as a cape; e.g. by disconnecting the unattached portions of the first and second straps from the complementary fasteners.

11 Claims, 15 Drawing Sheets

MULTI-FUNCTION GARMENT

RELATED APPLICATION

This application claims the benefit of U.S. Provisional application No. 62/483,036 filed on Apr. 7, 2017, which is in its entirety incorporated herein by reference.

FIELD OF THE INVENTION

The present application relates generally to a multi-function garment that can be worn as a cape in a variety of conformations or configurations, and also converted into a blanket. Some configurations may reduce the blanket's overall footprint and make it easily transportable. Other configurations of the convertible cape result in the formation or presentation of bustles, pockets, or attachment points for accessories, which can affect how the cape drapes when worn as a fashion accessory.

BACKGROUND OF THE INVENTION

In the field of outdoor equipment, blankets are known to provide a layer of protection and/or insulation from the elements. Blankets come in many different designs, depending on their use or preference for a user. For example, a blanket may be laid on ground that is wet, dirty, or cold, and thus provide comfort and protection for the user. Additionally, a blanket may be wrapped around a user to provide warmth and protection from sun, wind, rain, or other elements.

However, it can be cumbersome to package or transport a blanket, as blankets are not usually provided with handles or straps for transport. While a blanket may be folded in order to make it more easily transportable, it can easily become unfolded during transport unless it is bound up, causing it to be unwieldy to carry. If separate straps or bags are provided for lifting or storing the blanket for transport, the straps or bags are likely to be set aside and be lost when the blanket is in use.

Similarly, garments are known which provide a layer of protection and/or insulation when worn on a user. Such garments are usually constructed so as to conform to the user's body. Usually, such garments are single-purpose and are intended only to cover or conform to a specific portion of the user's body.

BRIEF SUMMARY OF THE INVENTION

In accordance with one aspect, a multi-function garment is composed of at least one layer of a flexible material having an inner face and an outer face. The faces meet at an edge provided along a perimeter of the garment. First and second straps are attached to at least one of the inner and outer faces of the garment via respective attached portions, each also having an unattached portion. The unattached portions have respective fasteners, for example at their terminal ends. The garment also has a first complementary fastener that is attached to at least one of the inner and outer faces of the garment and is selectively attachable to and releasable from the first strap's fastener, and a second complementary fastener that is attached to the same face and is selectively attachable to and releasable from the second strap's fastener. When the first strap's fastener is attached to the first complementary fastener and the second strap's fastener is attached to the second complementary fastener, the unattached portions of the first and second straps are usable as shoulder straps, so that the garment is wearable as a convertible cape.

The garment is usable as a blanket when the first fastener is released from the first complementary fastener and the second fastener is released from the second complementary fastener.

DESCRIPTION OF EXAMPLE EMBODIMENTS

Figure 1:
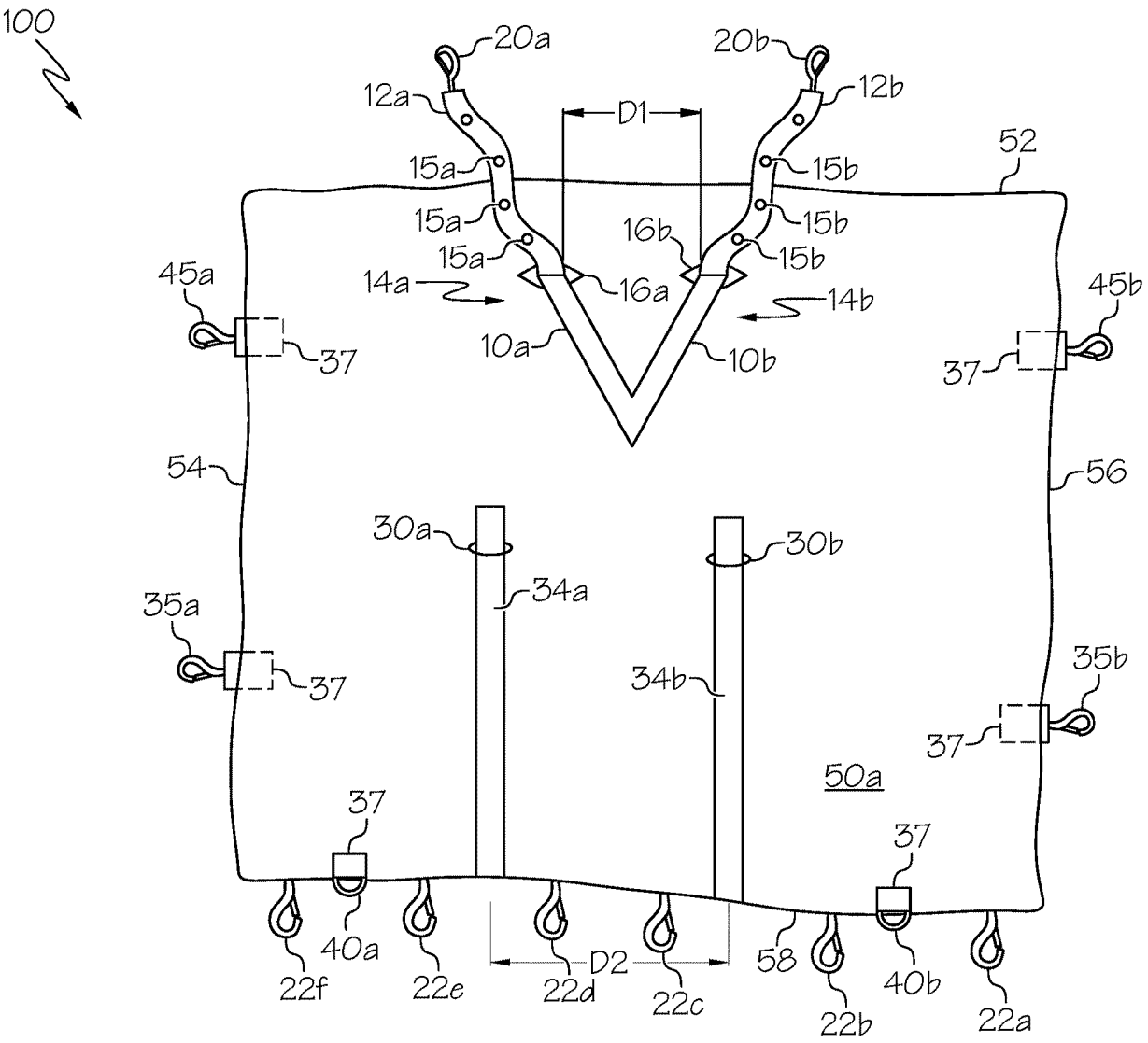
FIG. 1 is a plan view of a first face of a garment according to a first embodiment.

Example embodiments are described and illustrated in the drawings. These illustrated examples are not intended to be limiting. For example, one or more aspects or features from each embodiment can be combined with or utilized in other embodiments.

A convertible cape garment is disclosed herein, which has a first face and a second face opposite to the first face. Herein, the "inner face" refers to the face (first or second) that is in contact with the body of the user in a particular conformation, and the "outer face" refers to the face that is not in contact with the body of the user in that conformation. Both the "inner face" and the "outer face" together form the "exterior" of the garment, which may alternatively be referred to as "exterior face(s)." The garment may consist of only one layer. Alternatively, the garment may have two or more layers, which may alternatively be referred to as plies.

In this case, the garment additionally has two or more "interior" faces, which are located between the layers or plies. However, even in multi-ply or multi-layered embodiments, the exterior still consists of the inner face and the outer face, as described above in the single-ply example.

Turning to the embodiment shown in FIG. 1, a convertible cape garment 100 is illustrated. This may also be referred to as a convertible cape 100, a multi-purpose garment 100, or a garment 100. The garment 100 is made of one or more layers of flexible, preferably textile or fabric, material and has a first face 50*a* and a second face 50*b* (shown on FIG. 2). As noted above, when the garment is worn as a cape the inner face is in contact with the user's body and the outer face faces away from the user's body. In a preferred embodiment the garment 100 may be converted so that the inner face and outer face are switched such that the opposite face is now worn facing the user's body and vice versa.

Figure 2:
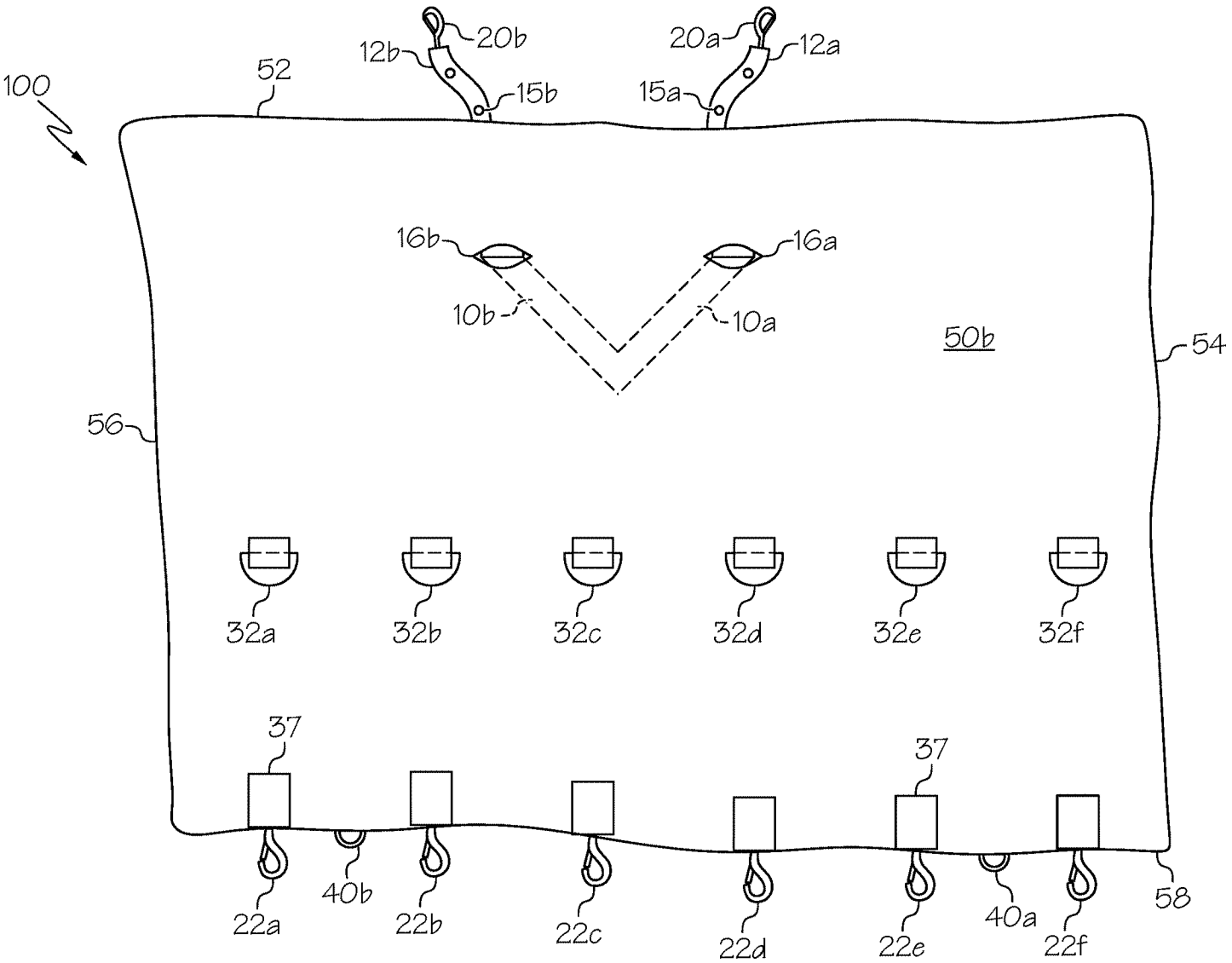
FIG. 2 is a plan view of a second face of the garment of FIG. 1.

In the embodiment of FIGS. 1-2, the first and second faces 50*a*, 50*b* meet at and are bounded by a continuous edge provided along and defining a perimeter of the garment 100. The perimeter edge is defined by the upper edge 52, the lower edge 58, the left edge 54, and the right edge 56 in this embodiment. These edges 52, 54, 56, 58 may be sealed, such as taped, glued, fused and/or sewn. If the garment 100 is multi-ply, then the plies or layers of the garment 100 may preferably be joined together at the edges 52, 54, 56, 58. If the garment 100 is single-ply, then the edges 52, 54, 56 and 58 may still be taped, glued, fused or sewn, to prevent unravelling. The corners at which adjacent edges 52, 54, 56, 58 intersect may be rounded or angular, and may also be sealed. The length of the edges 52, 54, 56, 58 is preferably chosen so that the garment 100 can be comfortably worn as a cape yet still provide adequate dimensions to serve as a blanket. For example, in an embodiment intended for an adult, the upper and lower edges are 50 to 100 inches, preferably 60 to 90 inches, and more preferably 70 to 80 inches, and the left and right edges are 40 to 90 inches, preferably 50 to 80 inches, and more preferably 60 to 70 inches. Notably, different-sized garments 100 can be produced for people of different sizes or heights, or to provide different bustling characteristics (further described below) when worn as a fashion accessory.

The garment 100 is preferably rectangular; but may also be provided in other shapes, such as a square or a trapezoid. The edges 52, 54, 56 and 58 may be provided as straight lines; or, in alternative embodiments, various ones or all of the edges 52, 54, 56, 58 can be curved, rounded, or contain zig-zags or other angular portions. Alternative shapes are shown, for example, in the embodiments shown in FIGS. 3 to 9. Additional edges may be provided, so that the garment 100 takes on a polygonal form, such as a pentagon or a hexagon. Alternatively, the form of the garment 100 may be irregular (such as the shape of a butterfly), with one or more curved or straight edges. In yet another alternative, the edges 52, 54, 56, 58 at the left, right, top and bottom, respectively, of the garment 100 may together define a single curved edge about its entire perimeter, so as to make a circular or oval form. In some embodiments, the garment 100 has bilateral symmetry, so that it can be worn symmetrically as a cape draped about a person. In other embodiments, the garment 100 has an asymmetrical design.

The layer(s) of the garment 100 can be made from decorated textile materials such as fabrics, skins or hides, as well as synthetic or polymeric materials such as polyester or vinyl, or combinations of any of these or any other flexible sheet-like materials. More particularly, any woven or knit material made of fibrous threads, or any nonwoven may be used for layers of the garment 100. The threads or fibers of which the fabric or textile may be produced can include any combination of natural fibers including but not limited to cotton, wool, or silk, as well as synthetic fibers including but not limited to nylon, rayon, or polyester. Alternatively, the material of the garment 100 layer(s) may be a non-fibrous material, including but not limited to materials such as leather, fur, ersatz leather or ersatz fur. The garment 100 may comprise a single layer of material, which is alternately referred to herein as single-ply. Alternatively, the garment 100 may comprise two or more layers of any combination of the materials listed above, in which case the garment 100 is said to be multi-layered or multi-ply.

The first and second faces 50*a*, 50*b* may be formed of the same material so as to be indistinguishable from each other, with respect to their surface characteristics. Alternatively, the first and second faces 50*a*, 50*b* may be made of materials that are distinct from each other and/or they can be ornamented differently.

Figure 9:
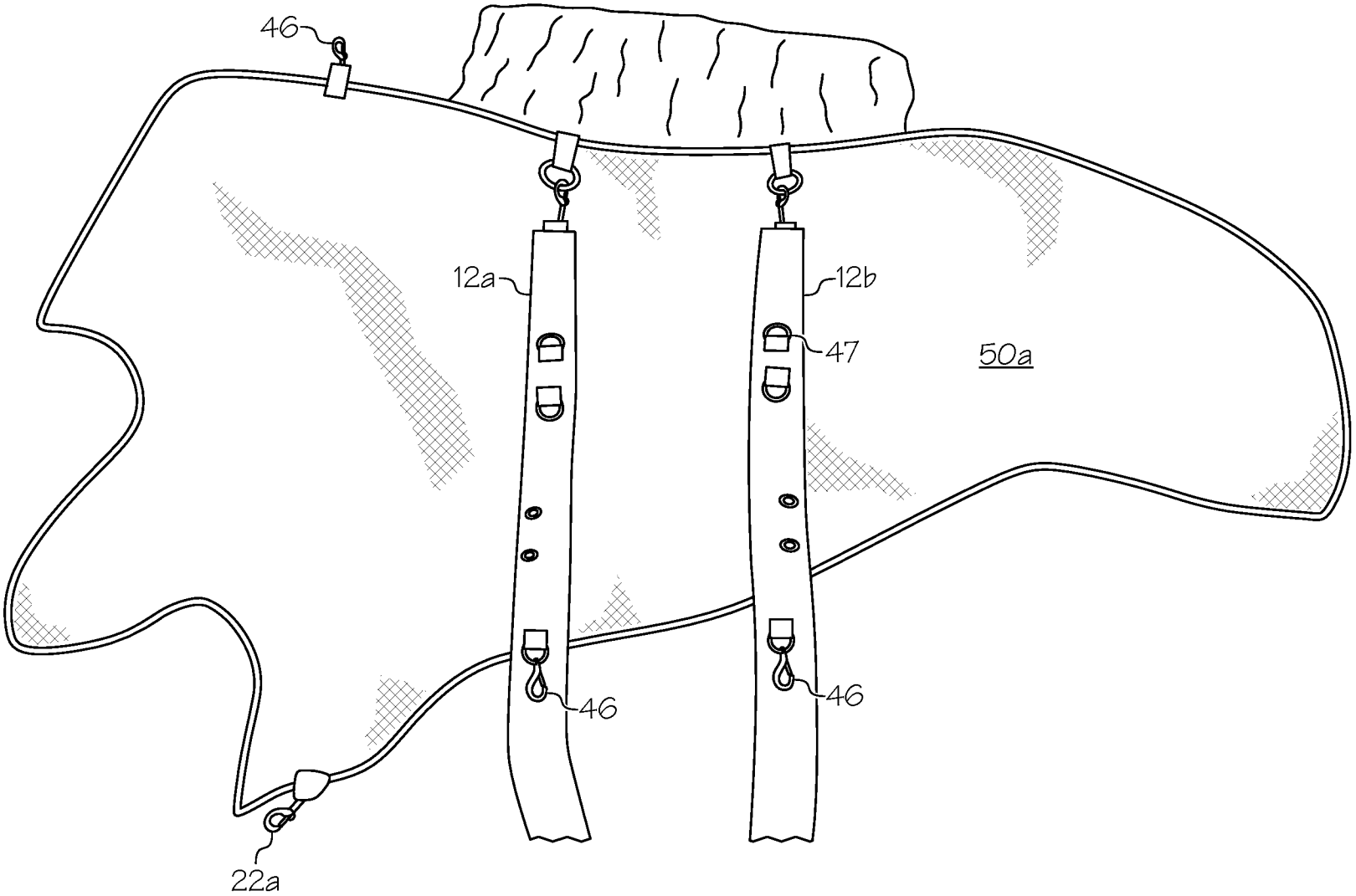
FIG. 9 is a plan view of a first face of a garment according to a fifth embodiment wherein terminal ends of the straps remain free.

In order to convert the garment 100 into a cape, shoulder straps are provided in the form of a first strap 14*a* and a second strap 14*b*. The first strap 14*a* and the second strap 14*b* are attached to the first face 50*a*. In particular, the first strap 14*a* has a first attached portion 10*a* that is attached to the first face 50*a* and a first unattached portion 12*a* that is not attached to the first face 50*a* but which extends freely therefrom. In other embodiments, the first and second straps 14*a* and 14*b* are removably attached to the first face 50*a*, as shown in FIG. 9.

A detailed description of only the first strap 14*a* is provided. The second strap 14*b* contains analogous components and can be fashioned similarly. The first attached portion 10*a* of the first strap 14*a* is sewn, glued, or otherwise attached to the garment 100. As shown in FIG. 1, the first attached portion 10*a* is attached to the first face 50*a*. In other embodiments, the first attached portion 10*a* is attached to the second face 50*b* of the garment 100. Alternatively, if the garment 100 has more than one layer, the attachment portion 10*a* may be attached to an interior surface of one of the layers between the first and second faces 50*a*, 50*b*, or even to multiple layers, e.g. via stitching the first attached portion 10*a* together with multiple layers.

The length of the first unattached portion 12*a* is such that when the garment 100 is worn as a cape, the first strap 14*a* rests on a shoulder or upper arm portion of the user. In other embodiments, the length of each strap from the bottom of the lowest attachable point allows for the straps to be tied around a user's waist for use as a belt in order to secure the garment to the user.

The first unattached portion 12*a* preferably includes one or more grommets 15*a* formed in the strap. The grommets 15*a* are preferably spaced at regular intervals, or may, in an alternative embodiment, be provided at irregular intervals along the length of the first unattached portion 12*a*. The grommets 15*a* may be provided as eyelets, and may be reinforced with metal or plastic collars, as known in the art. Alternatively, instead of grommets, rings, loops, or other fasteners may be affixed to or disposed in the first unattached portion 12*a* at spaced intervals. In yet another alternative, rather than grommets 15*a*, holes may be formed in the first unattached portion 12*a*.

At the terminal end of the first unattached portion 12*a*, a first clasp 20*a* is provided. However, the clasp 20*a* may be provided anywhere along the length of the first unattached portion 12*a*. The clasp 20*a* provided on the first unattached portion 12*a* may be a lobster clasp, as shown in FIG. 1. Alternatively, other types of releasable fastener may be used.

For example, fasteners with no spring-loading such as a hook, a buckle, a clip, or a tie may be used. Alternatively, spring-loaded fasteners may be used, such as a carabiner.

Preferably, the attached portions 10*a*, 10*b* of the first and second straps 14*a*, 14*b* are provided as lengths of strap that together form a V-shape. A width of the V-shape at its upper end is designated as D1 in FIG. 1 and corresponds to the shoulder width of the garment 100. This shoulder width D1 should be chosen such that the straps 14*a*, 14*b* rest comfortably on the shoulders of an average person, or of the person whose size is intended for the particular garment 100, wearing the garment 100 as a cape. As shown in FIG. 1, upper edges of the V-shape may be spaced from the upper edge 52 of the garment 100. In alternative embodiments, the upper edges of the V-shape may be located at or near the upper edge 52.

Alternatively, the lower ends of the attached portions 10*a*, 10*b* do not need to be joined to form a V-shape. For example, the attached portion 10*a* could be formed simply as an attachment tab, rather than as a length of strap. In yet another alternative, the attached portions 10*a*, 10*b* may cross to form an X-shape, or the attached portions 10*a* and 10*b* may be oriented vertically or otherwise, and/or may be parallel. In yet a further alternative the attached portions 10*a*, 10*b* can be nonlinear, such as curved or segmented.

The straps 14*a*, 14*b* can be formed of various strips of flexible materials, including ropes, cords, bands, ribbons, or other composites of woven, nonwoven, braided and/or multistrand fibers, or strips of fabric made from any of the above. The straps may be single-layer or multi-layer and may be reinforced. In one example, the straps could be made from a jacquard weave of the kind used in guitar straps. Alternatively, or in addition, the straps 14*a*, 14*b* can be provided as leather, suede, fur, or plastic reams or bands. Notably, the straps 14*a* and 14*b* can include combinations of any or all of the above features, as well as other structural features.

Furthermore, the garment 100 includes a first adjustment portion 34*a* and a second adjustment portion 34*b*, which function as tracks for sliding first and second rings 30*a*, 30*b* up and down. The adjustment portions 34*a*, 34*b* preferably are provided as respective straps attached to the garment 100. Each adjustment portion 34*a*, 34*b* is provided with a ring 30*a*, 30*b*, which may be slidable up and down the whole or a portion of the length of the respective adjustment portion 34*a*, 34*b*. The first ring 30*a* is slidably attached to the first adjustment portion 34*a* and is selectively attachable to and releasable from the first clasp 20*a*. The second ring 30*b* is slidably attached to the second adjustment portion 34*b* and is selectively attachable to and releasable from the second clasp 20*b*. The rings 30*a*, 30*b* are preferably D-rings. However, the rings 30*a*, 30*b* may also be implemented with other fasteners, such as O-shaped rings, loops of string, hooks, or clasps. In an alternative embodiment, the rings 30*a*, 30*b* may be fixed or sewn to the respective adjustment portions 34*a*, 34*b*. If the rings 30*a*, 30*b* are fixed to the respective adjustment portions 34*a*, 34*b*, then multiple rings 30*a*, 30*b* may be provided along the length of each adjustment portion 34*a*, 34*b*, at regular or irregular intervals.

In some embodiments, the positions of rings 30*a*, 30*b* on adjustment portions 34*a*, 34*b* may be adjusted for comfort after putting on the garment 100 to be worn as a cape. In any case, the distance between the rings 30*a*, 30*b* and the positions at which the corresponding unattached portions 12*a*, 12*b* of the straps 14*a*, 14*b* are joined to the garment 100 should correspond to the length of an imaginary line drawn from the user's shoulder to a point along the user's back below the armpit. In other words, the adjustment portions 34*a*, 34*b* should have a length sufficient to allow a comfortable fit when the garment 100 is worn as a convertible cape, with the unattached portions 12*a*, 12*b* acting as shoulder straps affixed to rings 30*a*, 30*b* located at an appropriate point along adjustment portions 34*a*, 34*b*.

Alternatively, the first and second adjustment portions 34*a*, 34*b* can be composed of strips of sewn-in straps or other features having one or a plurality of rings 30*a*, 30*b* fixedly positioned along their respective lengths, such that the attachment point of the respective first or second clasp 20*a* or 20*b* can be determined by selecting an appropriately positioned ring 30*a* or 30*b* along the respective adjustment portion 34*a* or 34*b*. The adjustment portions 34*a* and 34*b*, are more thoroughly described below.

The types of material used for the adjustment portions 34*a*, 34*b* include all types of material usable for straps 14*a*, 14*b*. A back width D2 between the adjustment portions 34*a*, 34*b* should preferably correspond to an approximated width of a user's back, as measured at an appropriate height, such as at the user's shoulders, armpits, waist or hips. A length of the adjustment portions 34*a*, 34*b* is preferably chosen such that attachment of the clasps 20*a*, 20*b* to respective rings 30*a*, 30*b* results in the straps 14*a*, 14*b* forming shoulder straps that are dimensioned to provide a comfortable fit for various sizes/shapes of people.

In alternative embodiments, the adjustment portions 34*a*, 34*b* may be provided in a non-parallel configuration, so that they are pointed inward or outward with respect to each other. Although the adjustment portions 34*a*, 34*b* are shown as being straight in FIG. 1, they may alternatively be curved or angular along a portion or the whole of their length. The adjustment portions 34*a*, 34*b* do not need to be attached along their entire length to the garment. They may be attached only adjacent their ends, so that a middle portion of the adjustment portions 34*a*, 34*b* hangs free from the garment 100. Alternatively, as shown in the embodiments of FIGS. 3-6, adjustment portions 34*a*, 34*b* may be omitted entirely. In this case, the rings 30*a*, 30*b* may be attached directly to the garment 100 or connected via attachment tabs to the garment 100. Alternatively, or in addition, multiple rings 30*a*, 30*b* may be provided, at regular or irregular intervals.

Optionally, a slit 16*a* may be provided in the garment 100 to provide communication therethrough at a location adjacent where the first unattached portion 12*a* extends from the first or second face 50*a* or 50*b* of the garment 100. If the garment 100 is formed of a multi-layer material, then the slit 16*a* should be provided as an opening or slot in all layers. A perimeter of the slit 16*a* may be sealed, for example by gluing, sewing, fusing, or taping one or more material layers together around the perimeter of the slit 16*a*. The slit 16*a* allows the cape garment 100 to be worn reversibly. This is done by threading the first unattached portion 12*a* through the slit 16*a* and drawing the first unattached portion 12*a* therethrough, so that the first unattached portion 12*a* is available to be used as a shoulder strap on the opposite face (i.e., on the second face 50*b*) of the garment 100. The slit 16*a* may be reinforced with one or more bars or discs provided at the perimeter of the slit 16*a*, to provide structural stability and prevent sides of the slit 16*a* from being drawn open from the weight of the garment 100.

Figure 3:
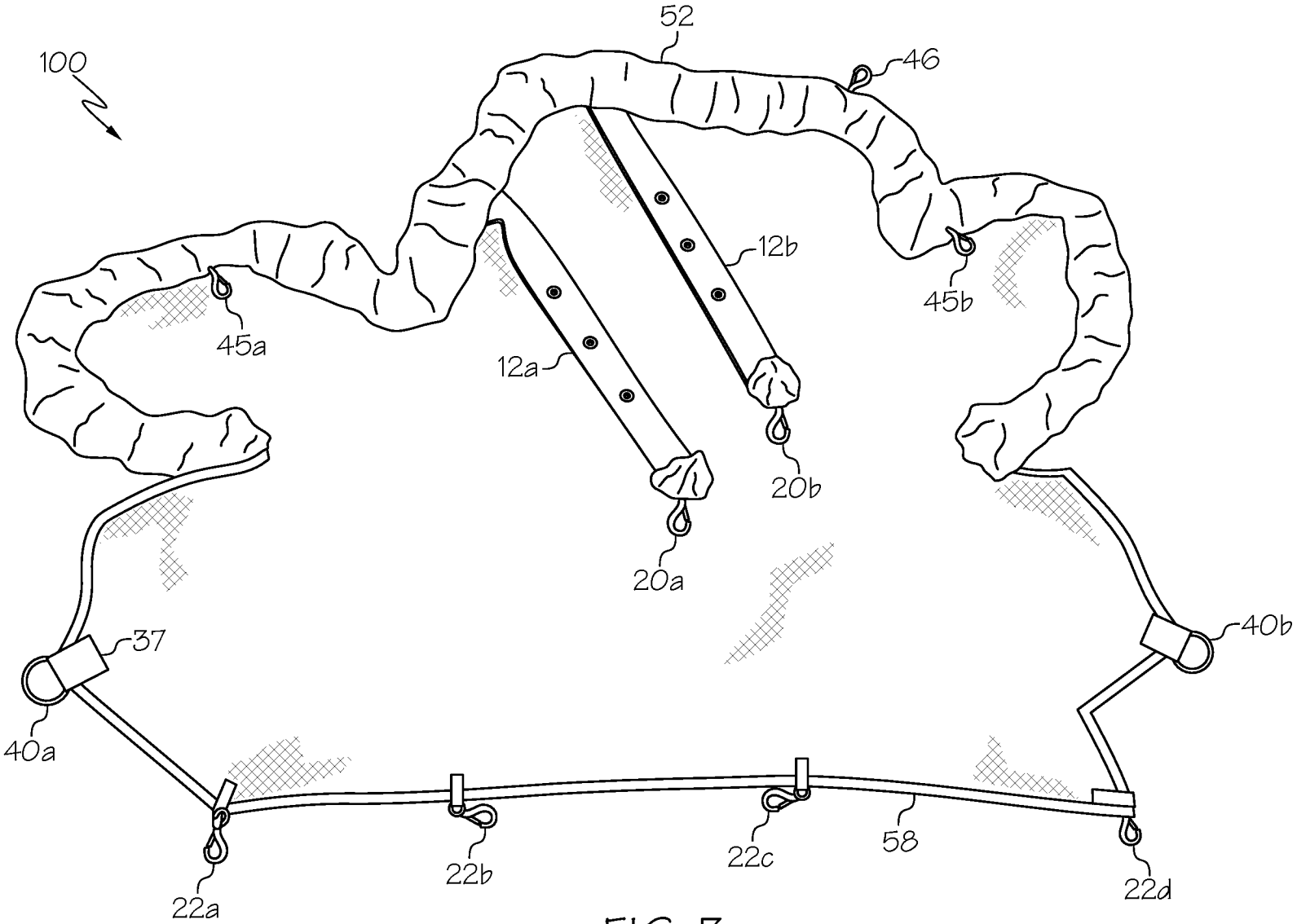
FIG. 3 is a plan view of a first face of a garment according to a second embodiment.

Lateral clasps 35*a*, 35*b*, 45*a*, 45*b* may be provided at or near left and right edges 54, 56 of the garment 100 so as to provide lateral bustles or wrapping of the garment around one's arms. The lateral clasps 35*a*, 35*b*, 45*a*, 45*b* may be attached directly to the garment 100, or else they may be connected to the garment 100 via an attachment tab 37. In other embodiments, the lateral clasps 45*a*, 45*b*, as shown in FIG. 3, provided at or near upper edge 52 of the garment 100 may be connected to form a neck closure. That is, when wearing the garment 100 as a cape the lateral clasps 45*a*, 45*b* provided on opposite sides of the upper edge, or on the left and right edges, may be connected to fold and conform the upper edge 52 about the neck so that the garment 100 is wearable about the neck.

In general, although only two lateral clasps 35*a*, 35*b*, 45*a*, 45*b* adjacent each edge 54, 56 are shown in the embodiment of FIG. 1, fewer or more lateral clasps may be provided. Preferably, the lateral clasps 35*a*, 35*b*, 45*a*, 45*b* are provided in a configuration which is bilaterally symmetric about the center of the garment 100. In other embodiments, the lateral clasps 35*a*, 35*b*, 45*a*, 45*b* are provided in an asymmetrical configuration.

FIG. 2 shows the second face 50*b* of the garment 100 in FIG. 1, wherein the second face 50*b* is provided with pocket clasps 22*a*-22*f* and pocket rings 32*a*-32*f* In an alternative embodiment, the pocket clasps 22*a*-22*f* and pocket rings 32*a*-32*f* are provided on the first face 50*a*. The pocket clasps 22*a*-22*f* are preferably at or near the lower edge 58. The pocket clasps 22*a*-22*f* may each be attached directly to the garment 100, or else they may each be connected to the garment 100 via a respective attachment tab 37.

The pocket rings 32*a*-32*f* are preferably on the garment 100 at a distance from the pocket clasps 22*a*-22*f*, with each pocket ring 32*a*-32*f* preferably associated with a respective pocket clasp 22*a*-22*f*. The pocket rings 32*a*-32*f* may each be attached directly to the garment 100, or else they may each be connected to the garment 100 via a respective attachment tab 37. The distance from each pocket clasp 22 to its respective pocket ring 32 is preferably constant. However, in other embodiments, the distance between each pocket clasp 22 and its respective pocket ring 32 is varied.

The pocket clasps 22*a*-22*f* are selectively attachable to respective ones of the complementary pocket rings 32*a*-32*f* so as to reversibly create a pocket formed in and as part of the garment 100. In order to form the pocket, the user connects respective ones of the pocket clasps 22*a*-22*f* to the corresponding pocket rings 32*a*-32*f* In order to convert the garment 100 back into a blanket, the user can simply release the pocket clasps 22*a*-22*f* from the respective pocket rings 32*a*-32*f* It is also contemplated that the user could form a partial pocket, by only connecting a subset of the pocket clasps 22*a*-22*f* to the corresponding subset of pocket rings 32*a*-32*f*.

The distance between a given pocket ring 32 and its corresponding pocket clasp 22 will be twice the depth of a pocket formed at that location. If desired, multiple arrays of pocket rings 32*a*-32*f* can be provided at successively larger distances from the corresponding pocket clasps 22*a*-22*f*, so that the user may select from among alternative desired pocket depths. When the user then puts on the garment 100, the lower edge of the garment 100 is usable as a pocket to hold items. In a further embodiment the resulting pocket could be used as a hand warmer if lateral edges of the garment 100 are folded from the back side around the sides of the user and its width is great enough to allow the user to place her hands in the side openings defined at the edges of the pocket.

Additional bustling rings 40*a*, 40*b* may be provided at or near the lower edge 58 of the garment 100, as shown in FIG. 1. The bustling rings 40*a*, 40*b* may be attached directly to the garment 100 or may be connected to the garment 100 via an attachment tab 37. The bustling rings 40*a*, 40*b* are couplable with clasps 20*a*, 20*b* so as to enable the user to wear the garment 100 as a cape as described above, but wherein the cape will be bustled at the bottom. In other words, instead of hooking clasps 20*a*, 20*b* into rings 30*a*, 30*b*, the user can hook the clasps 20*a*, 20*b* to the bustling rings 40*a*, 40*b*, which causes a lower portion of the garment 100 to fold inward and upward, thus bustling it at its lower end. Although FIG. 1 shows two bustling rings 40*a*, 40*b*, fewer or more bustling rings 40 may be provided. The bustling rings 40*a*, 40*b* are preferably provided in a configuration which is bilaterally symmetric about a center axis of the garment 100. The bustling rings 40 are preferably provided in an even number, such as 2, 4, 6, 8 or more. In other embodiments, an odd number is also contemplated.

In general, the rings 30*a*, 30*b*, the bustling rings 40*a*, 40*b*, and the pocket rings 32*a*-32*f* may be provided as D-rings, O-rings, grommets, or any other type of fastener that is couplable with clasps 20*a*, 20*b* and/or lateral clasps 35*a*, 35*b*, 45*a*, 45*b*. As an alternative, fasteners described herein as rings may instead be provided as clasps, while the clasps may instead be provided as rings. In each embodiment, a clasp-and-ring pairing as described above is implemented as a pair of complementary fasteners. The choice of which half of the fastener is the ring and which half of the fastener is the clasp is immaterial. In still further embodiments, it is contemplated that both of each pair of complementary fasteners could be clasps or hooks. For example, all of the various fasteners (including all of the various clasps and all of the various rings) described above could be provided as releasable clasps, such as carabiners.

Figure 11:
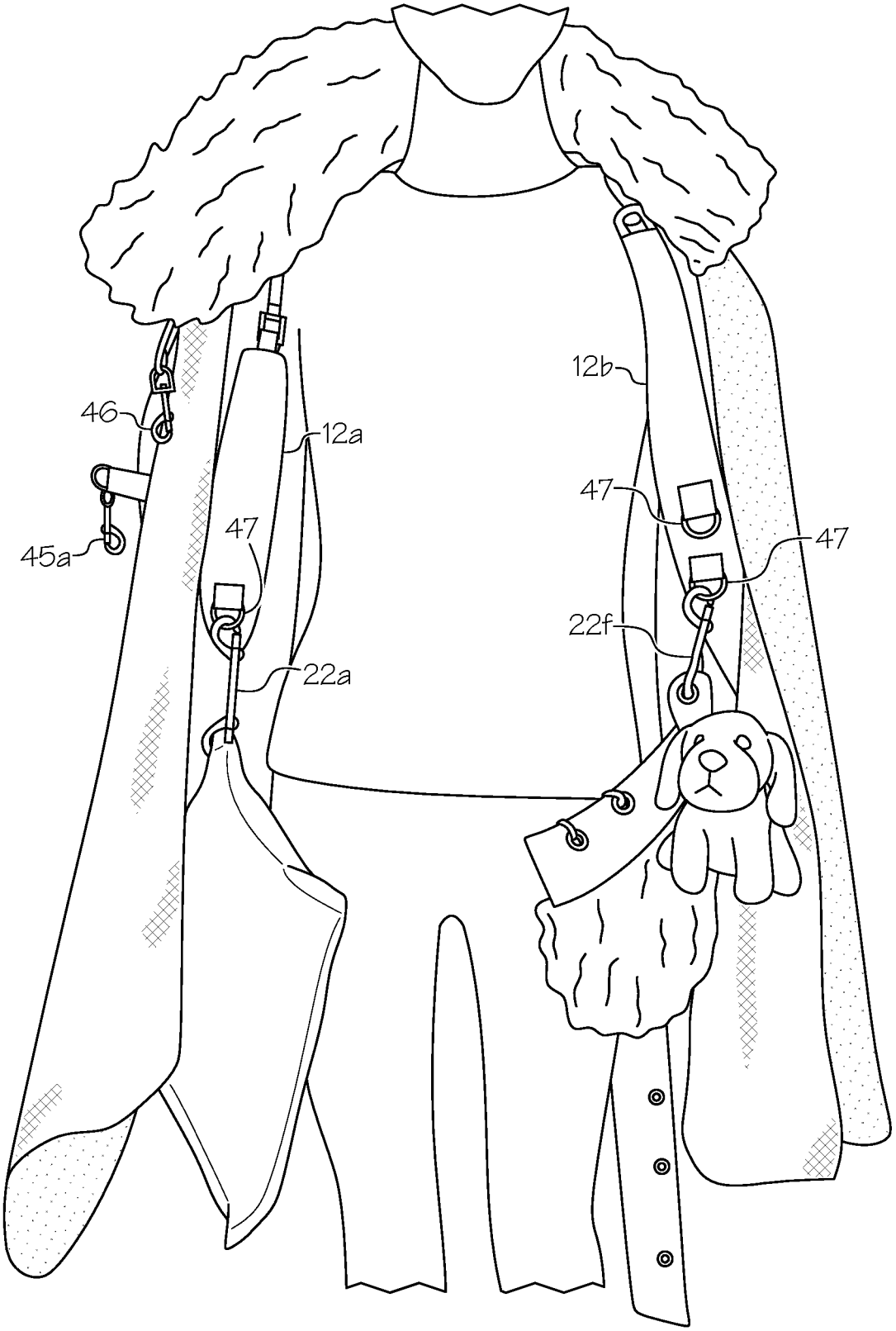
FIG. 11 illustrates the garment according to a seventh embodiment being worn over the shoulders, shown from the front.

In other embodiments, further functional clasps 46 and/or functional rings 47 may be provided. The functional clasps or rings may be attached directly to the garment 100, or else they may be connected to the garment 100 via an attachment tab 37. The functional clasps 46 or rings 47 may be provided at any location on the garment 100, including an edge, near an edge, toward a center, or at the center of the garment 100. The functional clasps 46 or rings 47 may serve further functions, such as for coupling accessories such to the garment 100 as shown in FIG. 11, or to serve as guide hooks for various straps or ties used to fold and/or tie the garment 100 into a packet.

In general, and as indicated above, attachment tabs 37 such as those shown in FIGS. 1-3 connect various fasteners to the garment 100, examples of said fasteners being the rings 30*a*, 30*b*, the bustling rings 40*a*, 40*b*, pocket rings 32*a*-32*f*, pocket clasps 22*a*-22*f*, the lateral clasps 35*a*, 35*b*, 45*a*, 45*b*, and/or further clasps. In other embodiments, attachment tabs 37 are provided in addition to or instead of the attached portions 10*a*, 10*b*. The attachment tabs 37 are made of textiles, leather, or synthetic materials with a desired strength. The attachment tabs 37 are attached to the garment 100 via sewing, gluing, stapling, or any combination of these methods. In some embodiments, the attachment tabs 37 are shaped as rectangles or squares. In other embodiments, the attachment tabs 37 are shaped as triangles, diamonds, ovals, circles, or any other shape. Depending on the application, the attachment tabs 37 may be sewn to the first or second face 50*a*, 50*b* of the garment 100. If the garment 100 has multiple layers or plies, attachment tabs 37 may be attached between layers on an interior of the garment 100. In this case, a slit can be provided in intermediate layers between the attachment tab 37 and one or both faces of the garment 100 to feed the desired fastener through to the exterior of the garment 100 and provide the desired fastener on the garment 100 exterior.

In some embodiments, the garment 100 has the identical configuration of fasteners on both the first and second faces 50*a*, 50*b*. In other embodiments, the configuration of the fasteners on the first and second faces 50*a*, 50*b* is different.

Below describes the different configurations

When unfurled as shown in FIG. 1, such that none of the illustrated fasteners is connected to any of the other fasteners, the garment 100 is in the conformation of, and can be used as, a conventional blanket. For example, it may be placed on the ground to provide a seating surface, or it may be wrapped for warmth. The garment 100 can be converted from this conformation into a wearable garment for transport, such as a cape, in the following manner. The first clasp 20*a* is attached to the first ring 30*a* and the second clasp 20*b* is attached to the second ring 30*b*. This results in the unattached portions 12*a*, 12*b* of the first and second straps 14*a*, 14*b* being usable as shoulder straps. In this manner a person can position his or her arms through the resulting shoulder straps such that the garment 100 now is in the form of a wearable garment on one's shoulders. With all other fasteners left unattached, the garment will drape down and be substantially in the form of a cape. If the first clasp 20*a* were released from the first ring 30*a* and the second clasp 20*b* were released from the second ring 30*b*, then the garment would return to its entirely unfurled conformation and could be laid flat and used as a blanket. In fact, depending on how far down the adjustment portions 30*a* and 30*b* the respective straps 14*a* and 14*b* are attached, it may be possible to completely unfurl the garment even without disconnecting the clasps 20*a* and 20*b*.

Figure 12:
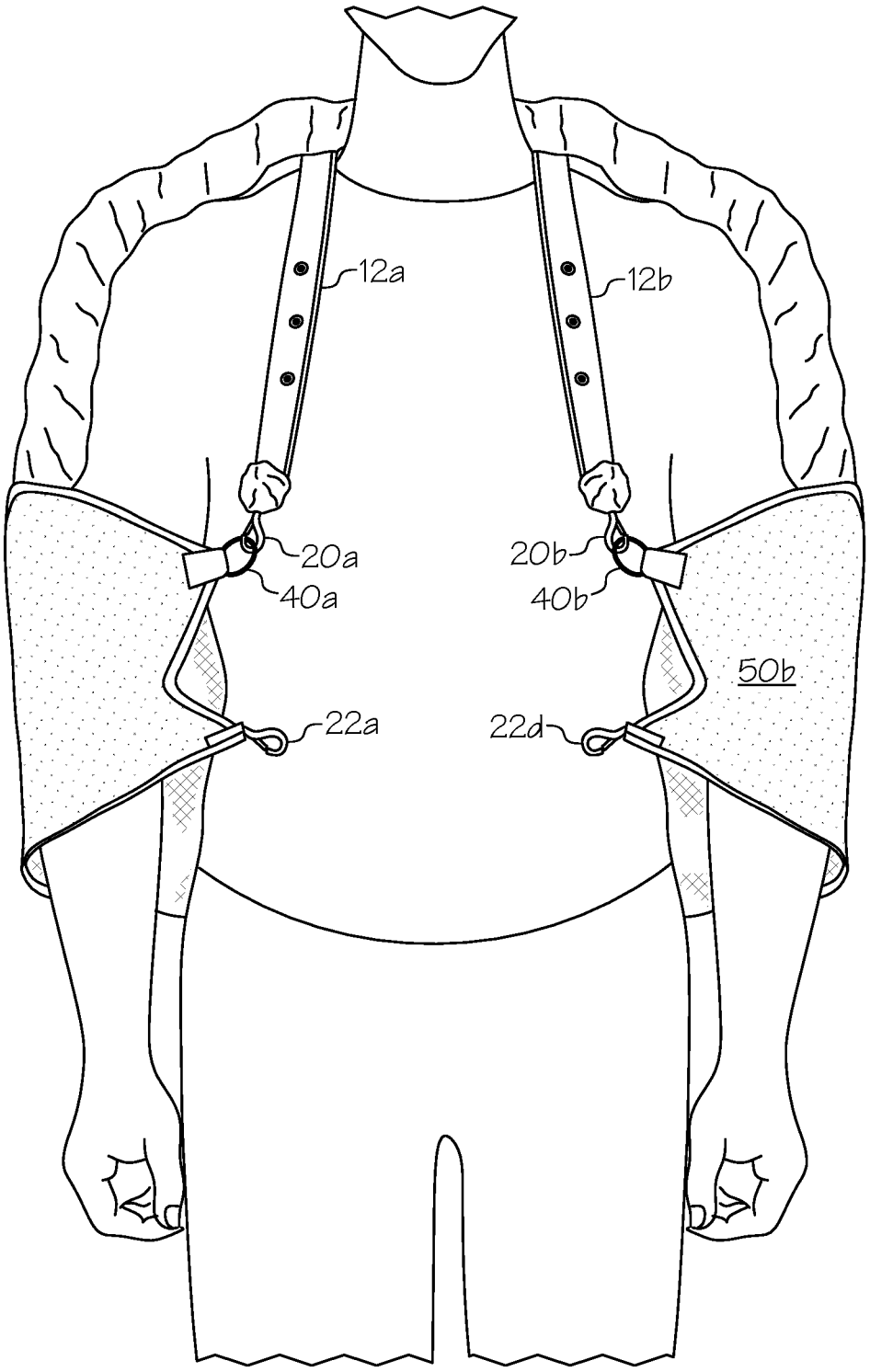
FIG. 12 illustrates the garment according to an eighth embodiment being worn over the shoulders and secured around and covering the user's arms.

If the garment 100 is to be used as a convertible cape, then in the case of movable or adjustable rings 30*a*, 30*b* first the rings 30*a*, 30*b* are slid to an appropriate position along adjustment portions 34*a*, 34*b*. If the rings are fixed directly to the face of the garment 100 or to the respective adjustment portion 34*a* or 34*b*, then the rings 30*a*, 30*b* are fixed at an appropriate height on the first or second face 50*a*, 50*b* of the garment 100 to provide the desired fit. For example, the user would place the first face 50*a* of the garment 100 having the respective adjustment portions 34*a* and 34*b* (which will become the inner face in this example) against the user's back and pull the first and second unattached portions 12*a*, 12*b* over each respective shoulder. The user then locates the clasps 20*a*, 20*b*, and pulls each of the clasps 20*a*, 20*b* downward toward each respective side of the user's ribcage. Finally, the user hooks clasp 20*a* into ring 30*a*, and hooks clasp 20*b* into ring 30*b*. In this way, each of the unattached portions 12*a*, 12*b* acts as a shoulder strap and is looped around one of the user's shoulders, as shown in FIGS. 11 and 12.

Alternatively, the user could lay the garment down in order to hook clasp 20*a* into ring 30*a*, and clasp 20*b* into ring 30*b*, before putting on the garment 100 by sliding each one of the user's arms into one of the shoulder straps formed by the unattached portions 12*a*, 12*b*, such that the first face 50*a* of the garment 100 lies against the user's back.

Figure 13:
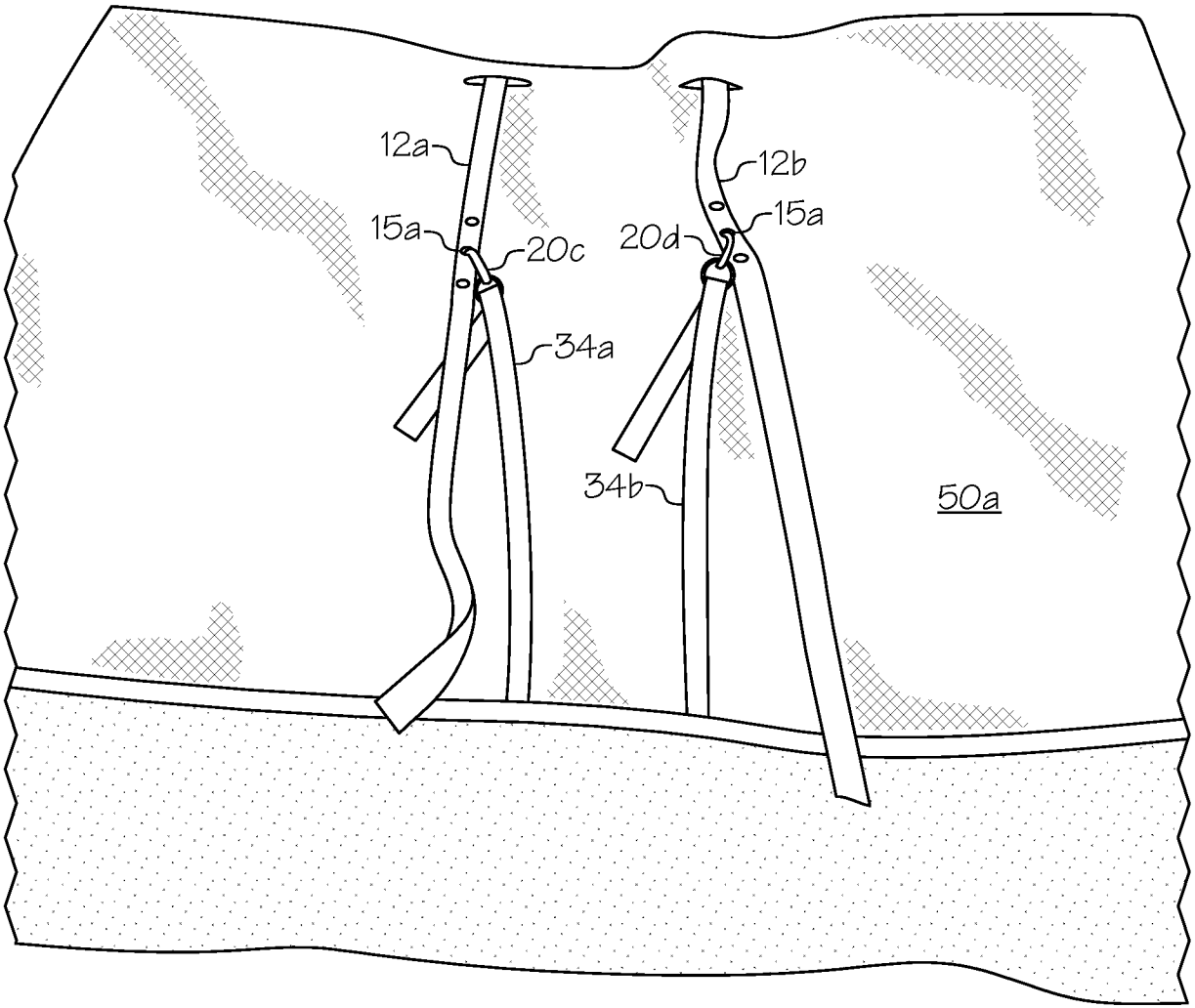
FIG. 13 is a plan view of a first face of the garment according to a ninth embodiment, wherein clasps on the adjustment portions are attached to openings in the straps.

In an alternative embodiment shown in FIG. 13, clasps 20*c*, 20*d* are provided on adjustment portions 34*a*, 34*b*, and the clasps 20*c*, 20*d* of the adjustment portions 34*a*, 34*b* are hooked to grommets 15*a*, 15*b* in the unattached portions 12*a*, 12*b* of the straps 14*a*, 14*b* in order to create shoulder straps to allow the garment 100 to be worn as a cape.

In still another alternative, after the user places the first face 50*a* of the garment 100 on the user's back and pulls one unattached portion 12*a*, 12*b* over each shoulder, the user could cross the unattached portions 12*a*, 12*b* before hooking the clasps 20*a*, 20*b* to the rings 30*a*, 30*b*. In this way, the unattached portions 12*a*, 12*b* form an X-shape over the user's chest, wherein clasp 20*a* is hooked into the ring 30*b* and the clasp 20*b* is hooked into the ring 30*a*.

Figure 4:
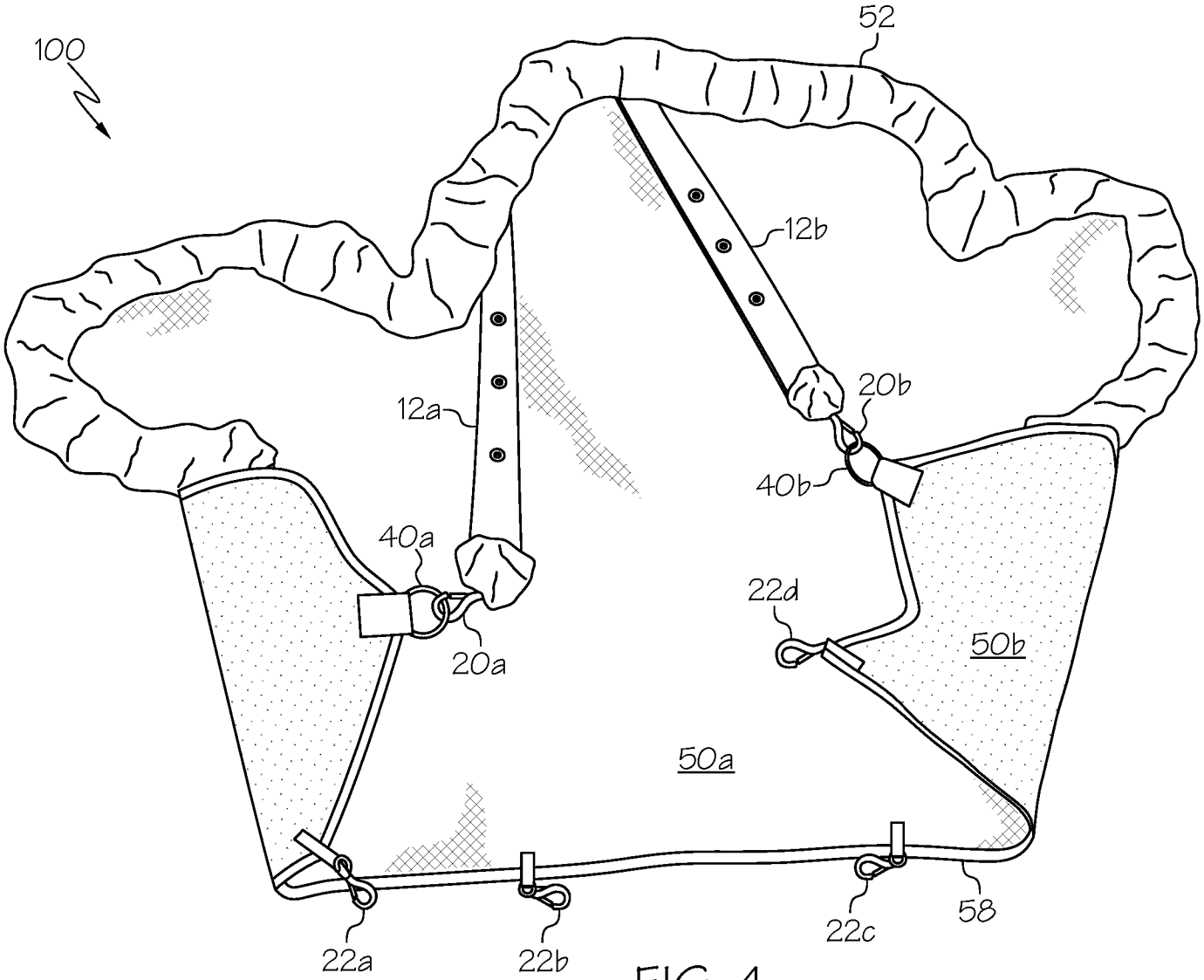
FIG. 4 is a view as in FIG. 3 showing a first bustled configuration.
Figure 5:
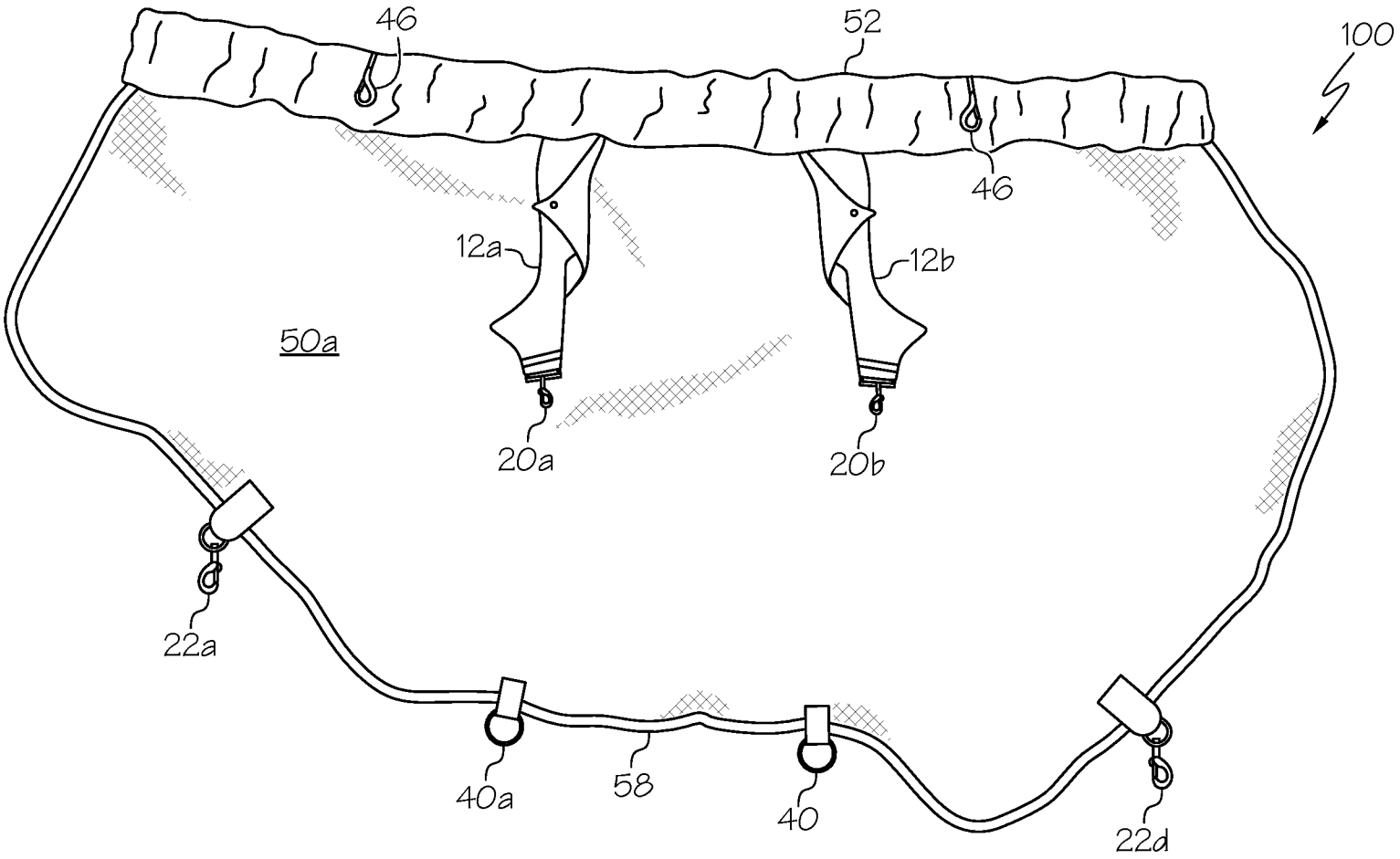
FIG. 5 is a plan view of a first face of a garment according to a third embodiment.
Figure 6:
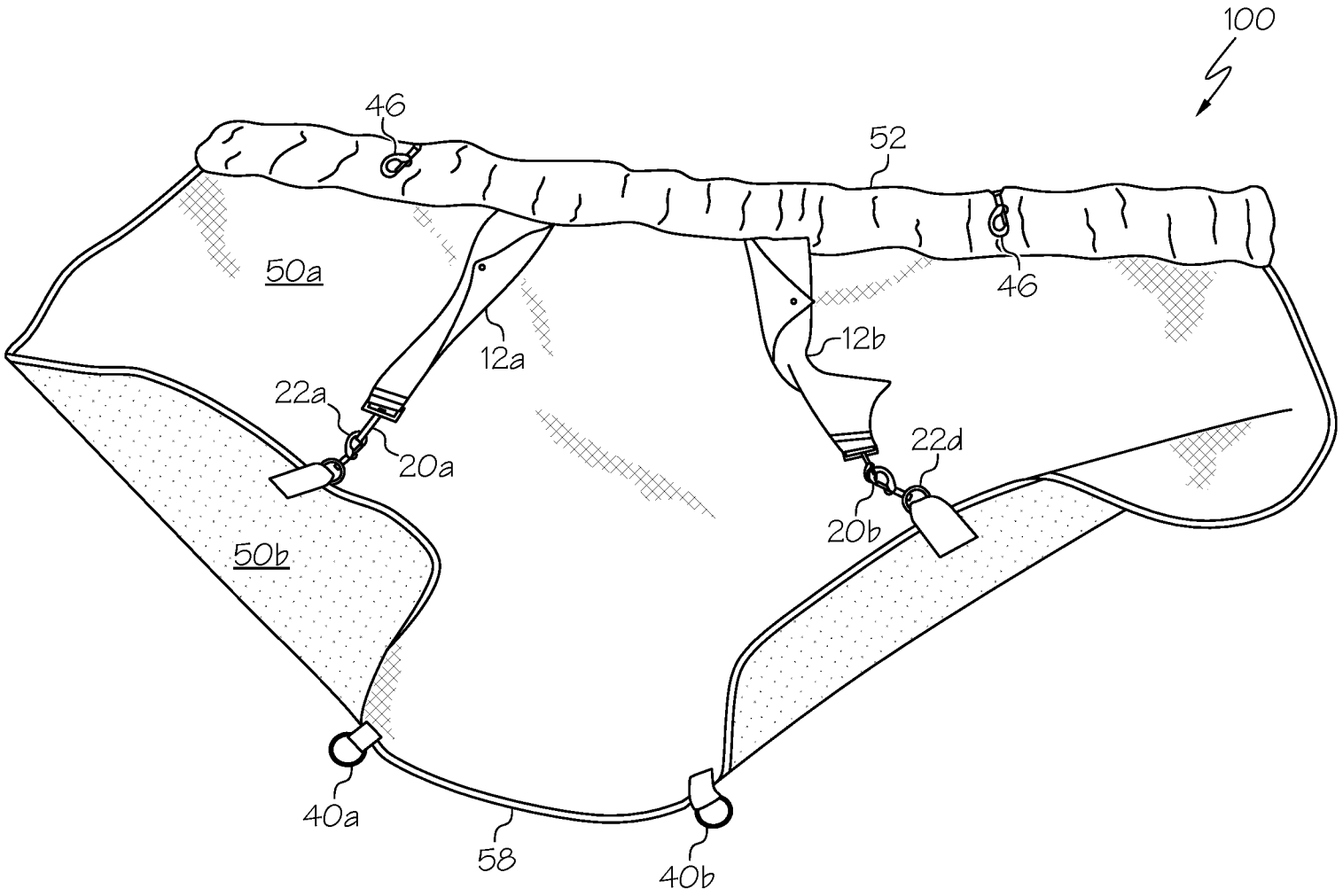
FIG. 6 is a plan as in FIG. 5 showing a first bustled configuration.
Figure 8:
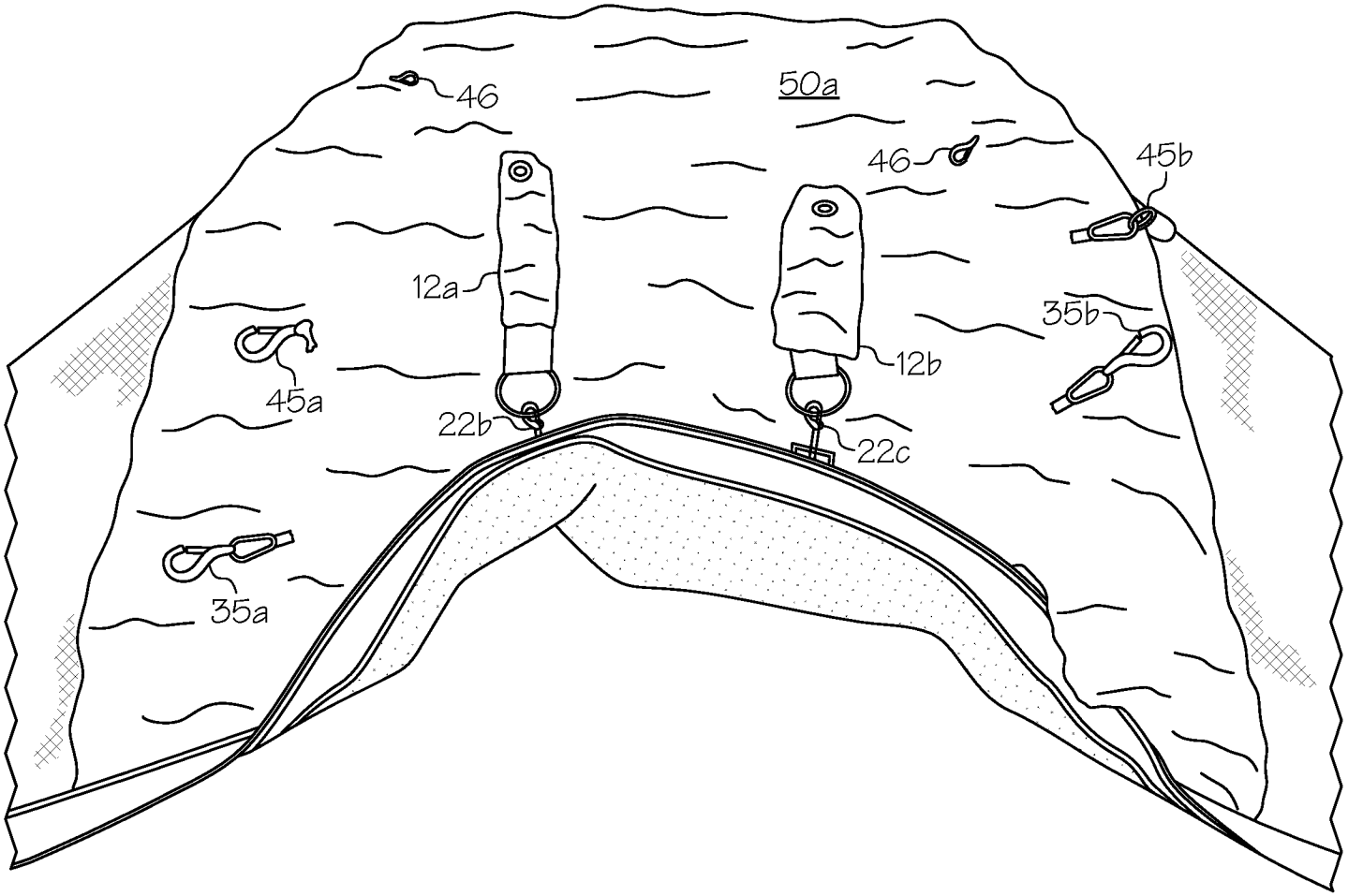
FIG. 8 is a plan view of a first face of the garment of FIG. 7 wherein the straps remain on the first face of the garment.

The two further embodiments shown in FIGS. 3 and 4, and in FIGS. 5 and 6, having different overall shapes. In these illustrated embodiments of the straps 14*a*, 14*b* are attached substantially at the upper edge 52 of the garment, with unattached portions 12*a* and 12*b* extending downward therefrom. But the unattached portions 12*a*, 12*b* of straps 14*a*, 14*b* may alternatively be spaced from the upper edge 52, as shown in the embodiment of FIG. 8. In either case, according to these embodiments a portion of the garment 100 between the attached portions 10*a*, 10*b* and the upper edge 52 can be folded over by guiding the straps 14*a*, 14*b* over the upper edge 52 to extend freely over the opposite face of the garment 100, thereby forming a folded collar from the portion of the garment that is folded over its upper edge 52. In other words, by reversing the face of the garment 100, a folded collar near the upper edge 52 of the garment 100 can be formed in particular embodiments.

Figure 15:
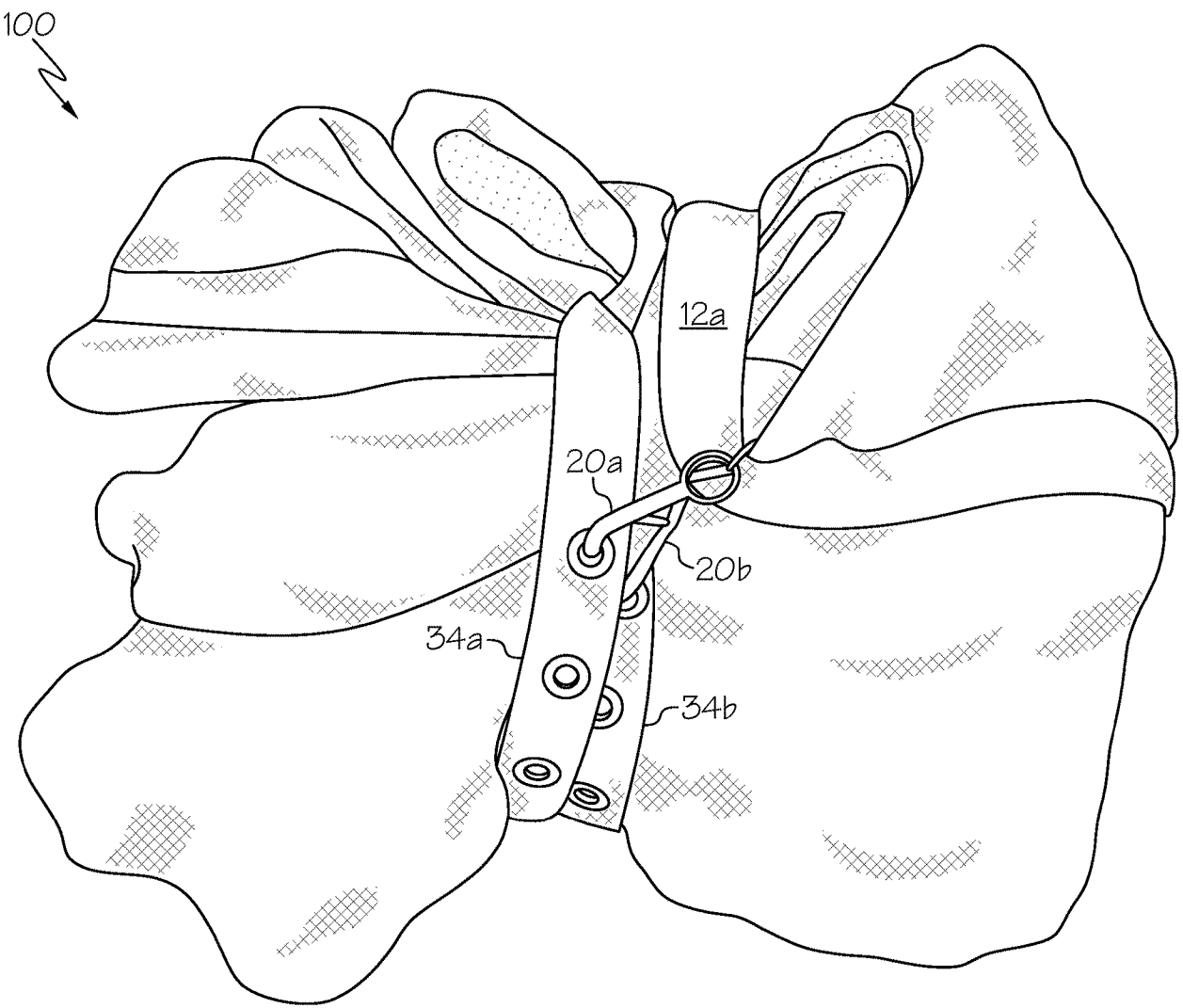
FIG. 15 shows the garment of FIG. 13 rolled up and fastened in a roll.

In yet another alternative, lateral clasps 35*a*, 35*b*, 45*a*, 45*b* or bustling rings 40*a*, 40*b* may be provided at or near the lower edge 58 of the garment 100, as shown in FIG. 4, so as to provide a bustle at the lower end. This may additionally enable the user to fold the garment 100 into a more compact conformation when worn as a cape. When the garment 100 is not being worn, it may be rolled or folded into a package and fastened using various pairs of the fasteners provided, as shown in FIG. 15. For example, the straps 14*a* and 14*b* may be used to roll and secure the garment 100 in a rolled or folded conformation for packing and travel.

Figure 14:
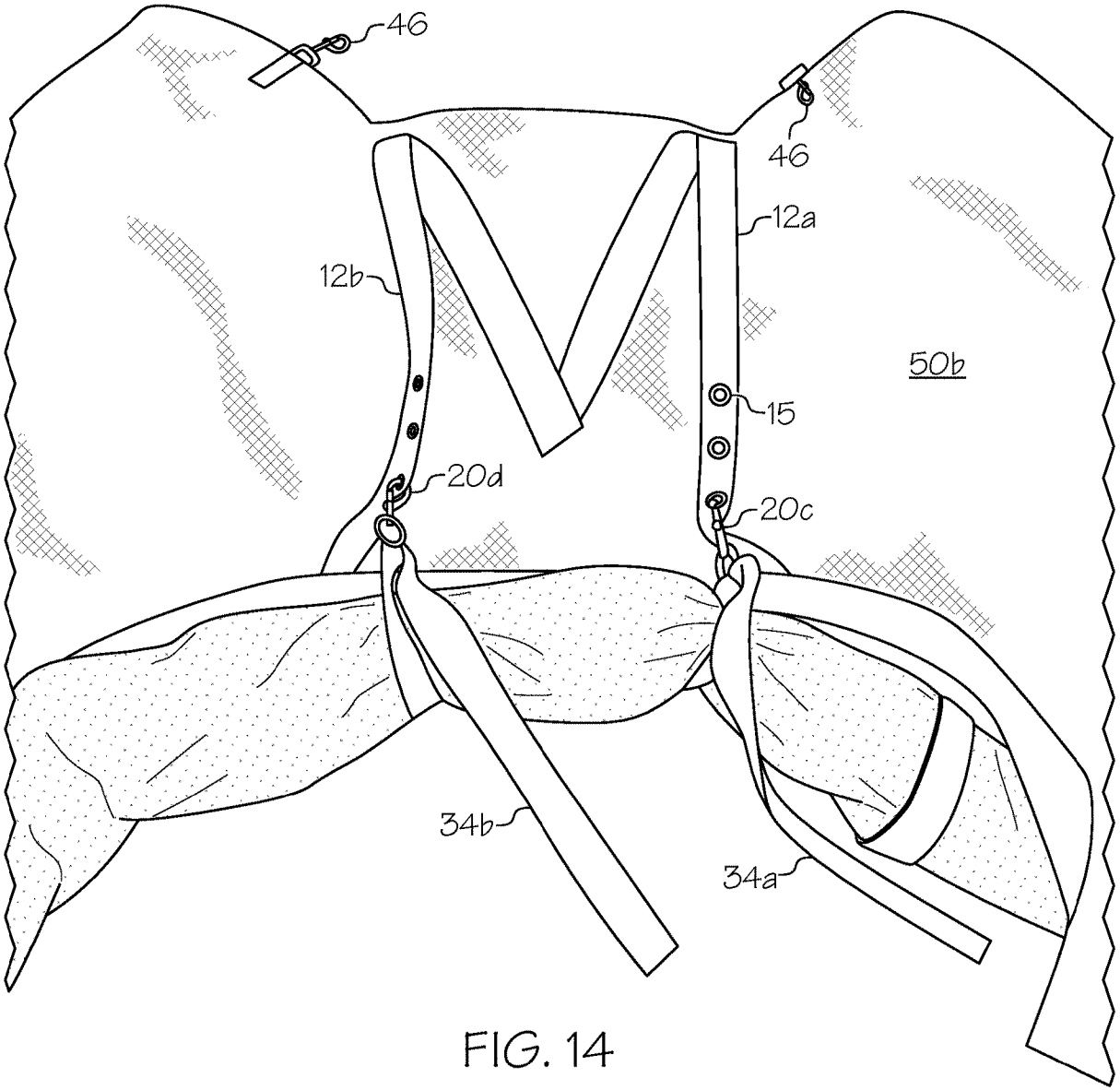
FIG. 14 is a view as in FIG. 13, wherein the garment has been partially rolled up beginning at a lower edge thereof.

When worn as a fashion accessory, a large number of bustling configurations become possible that enable the user to select how the garment 100 will be draped over the body, such as to provide desired appearance, warmth, coverage, protection, and/or breathability. Different bustling configurations may be selected for a particular occasion, to facilitate a desired appearance of formality or informality, or to highlight selected ornamental features displayed at different locations on the garment 100. Alternative bustled configurations for a variety of embodiments are shown in FIGS. 4, 6, 8, and 12. Yet another alternative bustled configuration is shown in FIG. 14, which features a roll formed by rolling up lower edge 58 not visible in this figure, but visible in FIGS. 3-7, and fastening it in its rolled configuration. Of course, folds and rolls of the kinds shown in FIGS. 7 and 14 may alternatively or in addition be implemented at various other edges of the garment 100.

Figure 7:
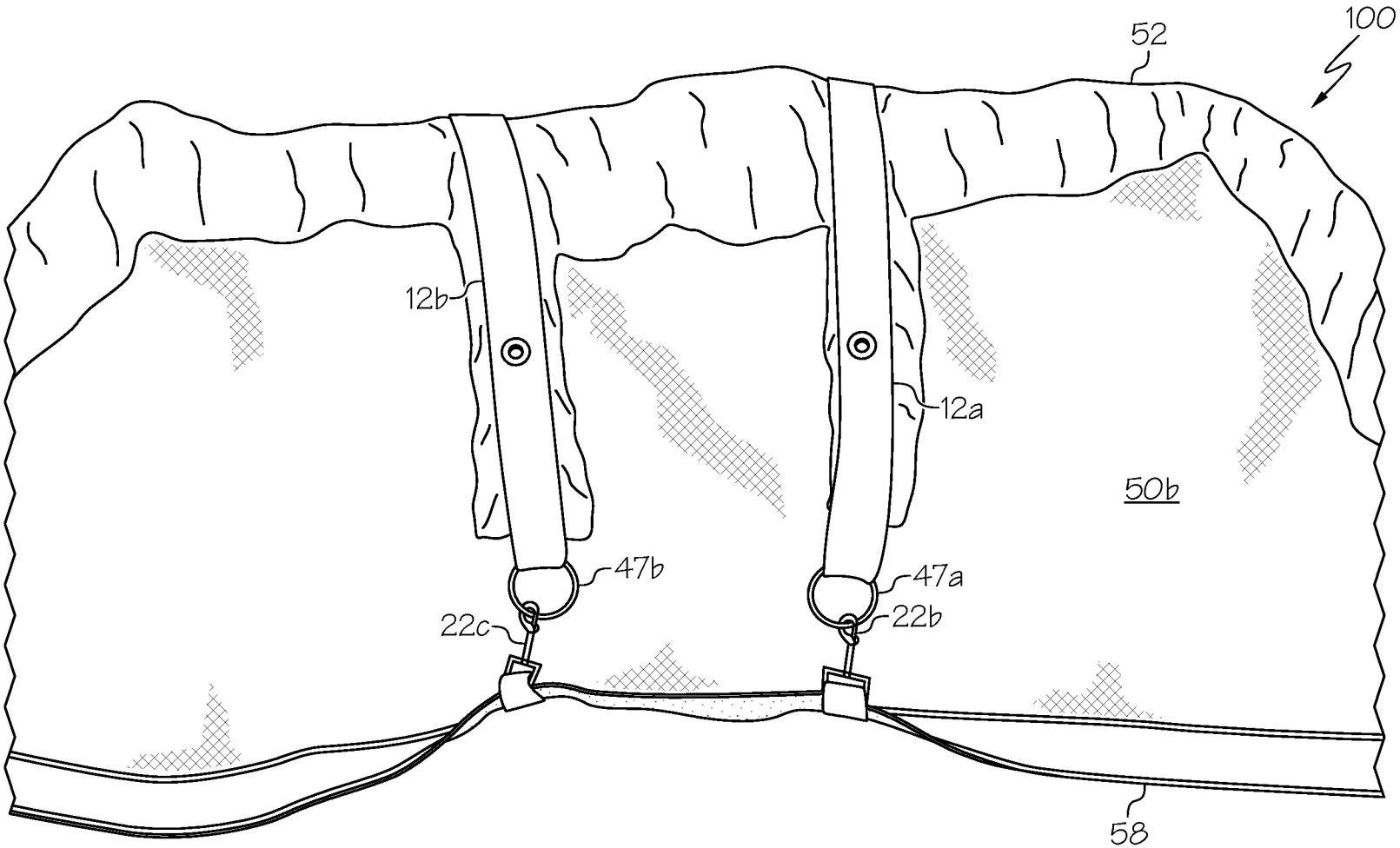
FIG. 7 is a plan view of a second face of a garment according to a fourth embodiment showing a first bustled configuration, wherein the straps that are positioned on a first face of the garment are drawn over an upper edge of the garment.

FIG. 7 shows an alternative embodiment in which the inner face may be converted to the outer face by guiding the unattached portions 12*a*, 12*b* of straps 14*a*, 14*b* over the upper edge 52 of the garment 100. Then, rings 47*a*, 47*b* provided at the terminal ends of straps 14*a*, 14*b* are affixed to the pocket clasps 22*b*, 22*c* provided on the other face or at the lower edge 58 of the garment 100. In this way, the inner and outer faces of the garment 100 are reversible.

Figure 10:
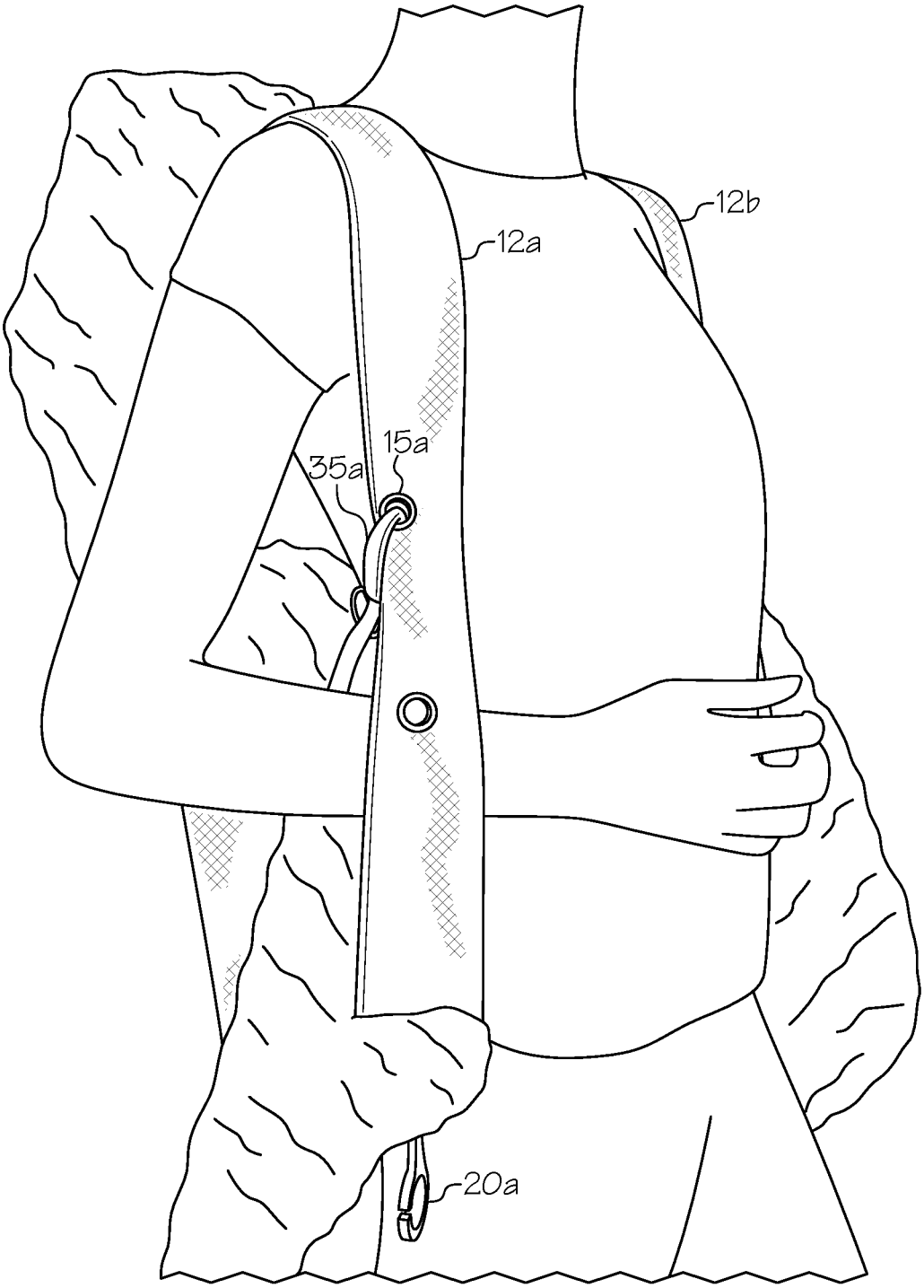
FIG. 10 illustrates the garment according to a sixth embodiment being worn over the shoulders, shown from the side.

In other embodiments, the lateral clasps 35*a*, 35*b*, 45*a*, 45*b* may be affixed to ones of the grommets 15*a*, 15*b* on the respective straps 14*a*, 14*b*, so as to create lateral bustles that do no enclose the user's arms, as shown in FIG. 10. By connecting the lateral clasps 35*a*, 35*b*, 45*a*, 45*b* to grommets 15*a*, 15*b* that are lower or higher along the unattached portions 12*a*, 12*b*, the length of the sleeve can be adjusted. Similarly, the location of the lateral clasps 35*a*, 35*b*, 45*a*, 45*b* on the garment 100 can be selected to provide a desired looseness or fit of various sleeve configurations.

The invention has been described with reference to the example embodiments described above. Modifications and alterations will occur to others upon a reading and understanding of this specification. Examples of embodiments incorporating one or more aspects of the invention are intended to include all such modifications and alterations insofar as they come within the scope of the appended claims.

What is claimed is:

1. A multi-function garment, comprising:

a layer of flexible material having a first face and a second face that meet at an edge along a perimeter of the garment;

a first strap having a first attached portion that is attached to the first face and a first unattached portion that extends freely from said first face, and a first fastener on the first unattached portion;

a second strap having a second attached portion that is attached to the first face and a second unattached portion that extends freely from said first face, and a second fastener on the second unattached portion;

a first complementary fastener attached to said garment and being selectively attachable to and releasable from the first fastener; and a second complementary fastener attached to said garment and being selectively attachable to and releasable from the second fastener;

a first slit in the garment adjacent where the first unattached portion extends from the first face, and a second slit in the garment adjacent where the second unattached portion extends from the first face, wherein attaching the first fastener to the first complementary fastener and the second fastener to the second complementary fastener yields first and second shoulder straps, respectively, to facilitate wearing said garment as a convertible cape, and wherein the first unattached portion is threadable through the first slit and the second unattached portion is threadable through the second slit, so that both said first and second unattached portions extend over said second face from the respective first and second slits.

2. The multi-function garment of claim 1, further comprising:

two or more pocket clasps and two or more respective, complementary pocket rings, said pocket clasps and pocket rings being positioned so that upon selective attachment of each said pocket clasp to its respective pocket ring a pocket is reversibly formed in and as part of the garment at or adjacent a lower edge thereof.

3. The multi-function garment of claim 1, further comprising a plurality of lateral clasps attached at or adjacent the edge thereof, at least one of said plurality of lateral clasps being selectively attachable to the unattached portion of said first strap so as to form a sleeve.

4. A multi-function garment, comprising:

a layer of flexible material having a first face and a second face that meet at an edge along a perimeter of the garment;

a first strap having a first attached portion that is attached to the first face and a first unattached portion that extends freely from said first face, and a first fastener on the first unattached portion;

a second strap having a second attached portion that is attached to the first face and a second unattached portion that extends freely from said first face, and a second fastener on the second unattached portion;

a first complementary fastener attached to said garment and being selectively attachable to and releasable from the first fastener; and a second complementary fastener attached to said garment and being selectively attachable to and releasable from the second fastener;

a bustle ring provided on the first unattached portion; and a plurality of bustle clasps attached to the garment at or adjacent the edge thereof;

the bustle clasps being attachable to the bustle ring so as to selectively bustle the garment in a plurality of different bustled configurations, wherein attaching the first fastener to the first complementary fastener and the second fastener to the second complementary fastener yields first and second shoulder straps, respectively, to facilitate wearing said garment as a convertible cape.

5. A multi-function garment, comprising:

a layer of flexible material having a first face and a second face that meet at an edge along a perimeter of the garment;

first and second straps having free portions and being attached on the first face;

first and second complementary fasteners on the garment; and first and second slits in the garment located adjacent to where said free portions of said first and second straps, respectively, extend from said first face, said free portions of the first and second straps being threadable through the respective slits;

wherein in a first configuration the first and second straps and first and second complementary fasteners are unattached, and the multi-function garment is a blanket, wherein in a second configuration the first and second straps and first and second complementary fasteners are connected, respectively, to form shoulder straps, and the multi-function garment is a cape, and wherein in a third configuration the garment is rolled or bunched into a compacted shape and the first and/or second straps is/are wrap-able around the garment to maintain the compacted shape.

6. The multi-function garment of claim 5, said first and second complementary fasteners being provided on said first face, wherein the first and second straps are removably attached thereto on the first face.

7. The multi-function garment of claim 6, said first and second complementary fasteners being provided on said second face, the first strap being threaded through the first slit and the second strap being threaded through the second slit, wherein said first and second straps are removably attached to the respective complementary fasteners on the second face.

8. The multi-function garment of claim 5, wherein the first and second straps are adapted to be spaced apart a width that corresponds to an approximate distance between a user's shoulders when worn.

9. The multi-function garment of claim 5, further comprising:

two or more pocket clasps provided on the first face or on the edge; and two or more respective, complementary pocket rings provided on the first face or on the edge;

wherein the pocket clasps are selectively attachable to the complementary pocket rings so as to reversibly create a pocket formed in and as part of the garment.

10. The multi-function garment of claim 5, further comprising:

a bustle ring provided on the first strap; and a plurality of bustle clasps attached to the garment at or adjacent the edge thereof;

the bustle clasps being attachable to the bustle ring so as to selectively bustle the garment in a plurality of different bustled configurations.

11. The multi-function garment of claim 5, further comprising a plurality of lateral clasps attached at or adjacent the edge thereof, at least one of said plurality of lateral clasps being selectively attachable to the first strap so as to form a sleeve about a user's arm.

* * * * *